US007628382B2

(12) United States Patent
Cole

(10) Patent No.: US 7,628,382 B2
(45) Date of Patent: Dec. 8, 2009

(54) NAIL EXTRACTOR, MOULDING REMOVER AND PRY BAR TOOL WITH INDEXABLE HEAD

(76) Inventor: Charles Cole, 708 Odenville Dr., Wylie, TX (US) 75098

( * ) Notice: Subject to any disclaimer, the term of this patent is extended or adjusted under 35 U.S.C. 154(b) by 0 days.

(21) Appl. No.: 12/009,780

(22) Filed: Jan. 22, 2008

(65) Prior Publication Data

US 2008/0179576 A1 Jul. 31, 2008

Related U.S. Application Data

(60) Provisional application No. 60/897,999, filed on Jan. 30, 2007.

(51) Int. Cl.
*B66F 15/00* (2006.01)
*B25C 11/00* (2006.01)

(52) U.S. Cl. ..... 254/25; 254/26 R; 254/131

(58) Field of Classification Search ..... 254/26 R, 254/25, 21, 20, 131
See application file for complete search history.

(56) References Cited

U.S. PATENT DOCUMENTS

| | | | | |
|---|---|---|---|---|
| 7,025,331 | B2 * | 4/2006 | Whelan | 254/25 |
| 7,039,993 | B1 * | 5/2006 | Smith et al. | 29/235 |
| 7,278,626 | B1 * | 10/2007 | Chang | 254/25 |
| 7,438,279 | B2 * | 10/2008 | Eby et al. | 254/25 |
| 2004/0069978 | A1 * | 4/2004 | Whelan | 254/25 |
| 2007/0158626 | A1 * | 7/2007 | Chang | 254/25 |
| 2008/0179576 | A1 * | 7/2008 | Cole | 254/26 R |

* cited by examiner

*Primary Examiner*—Lee D Wilson

(57) ABSTRACT

A tool head member being a nail extractor or molding remover having a striking surface on the end opposite the nail extractor/molding remover end or a pry bar, any of the foregoing tool head members being indexably coupled to a handle member. The indexable tool head allows the user to lockably index the tool head into a more desirable position for removing nails or molding.

16 Claims, 6 Drawing Sheets

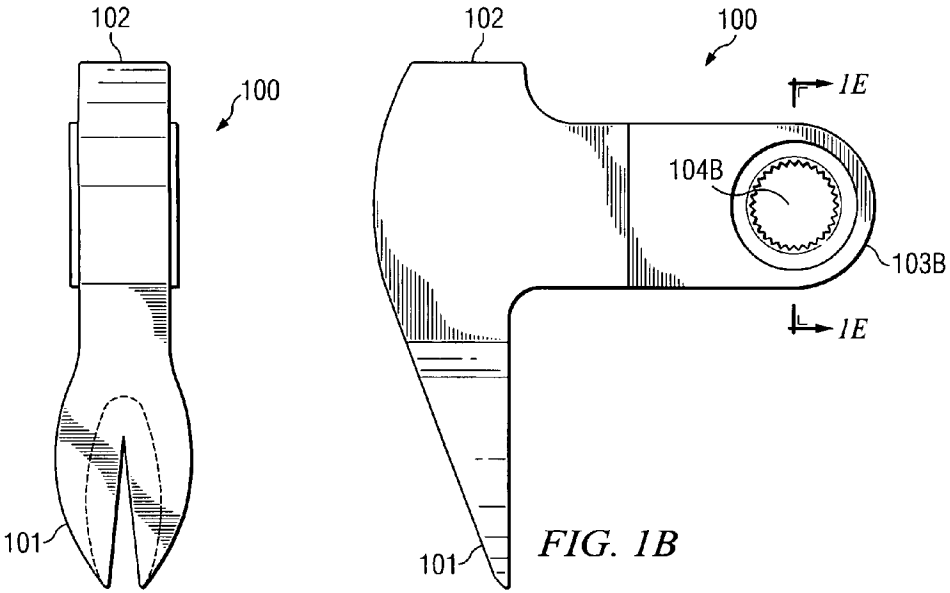
FIG. 1A
FIG. 1B
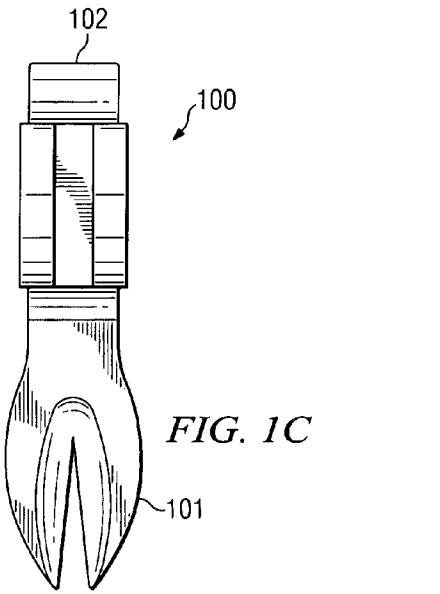
FIG. 1C
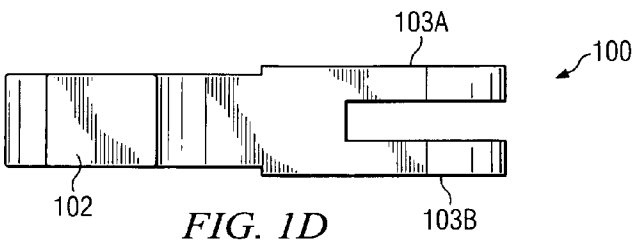
FIG. 1D
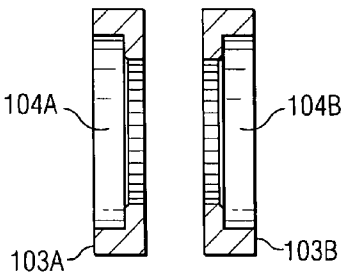
FIG. 1E

NAIL EXTRACTOR, MOULDING REMOVER AND PRY BAR TOOL WITH INDEXABLE HEAD

CROSS REFERENCE TO RELATED APPLICATIONS

This application is entitled to and hereby claims the benefit of the filing date of Provisional Application Ser. No. 60/897,999 entitled "Nail Extractor/Moulding Remover Tool Heads Each Having A Striking Surface and Pivoting Head, filed Jan. 30, 2007.

TECHNICAL FIELD

The present invention relates to hand tools and particularly to nail extraction, and moulding removal and pry bar tools. As used herein, moulding refers to ceiling moulding, wall moulding, wall trim, door and window moulding and trim and the like.

BACKGROUND OF THE INVENTION

Nail extractors, moulding removers and pry bars are known in the art to have handle members rigidly attached to the tool heads, and with respect to the nail extractors and moulding removers, such tool heads being substantially orthogonal to said handles. The tool head of a conventional nail extractor typically includes a first end having a slot into which the head of a nail can be inserted. The head of a conventional moulding remover has a first end having a graduated surface adapted to allow the end thereof to be inserted between, for example, a wall and the interior surface of the moulding so as to allow the moulding to be separated from the wall. The head of a conventional pry bar may be curved back from the handle member. An end of each such tool head may have a slot in the shape of a, e.g., "v" cut therein adapted to receive a nail below the nail head thereof, so as to allow its removal from, e.g., a wall. However, neither of the conventional nail extractor or moulding remover tool heads include on the head thereof a striking surface opposite the nail extractor or moulding remover tool head. Further, none of such conventional nail extractor/moulding remover/pry bar tools has an indexable, coupling mechanism coupling the tool head to the handle so as to allow the user to pivot the tool head into a more desirable position for, e.g., removing nails or moulding.

SUMMARY OF THE INVENTION

The present invention relates to hand tools and particularly to a tool head and tool handle, the first embodiment of the tool head being a nail extractor, the second embodiment of the tool head being a moulding remover, and the third embodiment being a pry bar, each such embodiment having a handle member coupled to the tool head with an indexable coupling mechanism, such indexable coupling mechanism being adapted to provide lockable tool head movement relative to the handle. More particularly, the invention relates to a tool head comprising either a nail extractor, moulding remover or pry bar, each of the nail extractor and moulding remover having a striking surface opposite the end of the nail extractor or moulding remover, as the case may be, and each being indexable and lockable with respect to its handle member. The indexable, lockable head allows the user to index the tool head into a more desirable position for removing nails or moulding.

BRIEF DESCRIPTION OF THE DRAWINGS

The invention will be better understood and its numerous objects and advantages will become more apparent to those skilled in the art by reference to the following drawings, in conjunction with the accompanying specification, in which:

FIGS. 1A-1E are views of the nail extractor head in a first embodiment of the present invention;

DESCRIPTION OF THE INVENTION

Figure 2A:
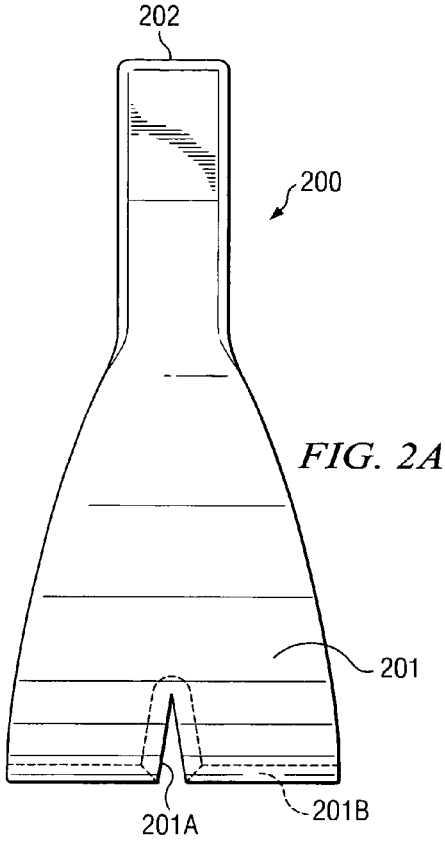
FIGS. 2A-2E are views of the moulding remover head in a second embodiment of the present invention.

As illustrated in the Figures described below, the present invention comprises a tool head and tool handle, the first embodiment of the tool head being a nail extractor, the second embodiment of the tool head being a moulding remover and the third embodiment being a pry bar, each such embodiment having a handle member coupled to the tool head with an indexable coupling mechanism, such indexable coupling mechanism being adapted to provide lockable tool head movement relative to the handle. Each of the first and second embodiment of the tool head has a striking surface on an end thereon, each of the embodiments of the tool head being indexable and lockable with respect to its handle member. The indexable head allows the user to pivot the head (with respect to the handle) into a more desirable position for, e.g., removing nails or moulding. The indexable coupling mechanism couples a handle member having a first splined receptacle to a tool head having an upper prong with a second splined receptacle and a lower prong with a third splined receptacle, and a splined pin assembly for insertion through said first, second and third receptacles. The handle member includes there-through the first splined receptacle and is positioned between the upper prong and the lower prong of the tool head with the first splined receptacle coaxially aligned with the second and third splined receptacles of the tool head. Alternatively, the indexable coupling mechanism couples a tool head having a first splined receptacle to a handle member having an upper prong with a second splined receptacle and a lower prong with a third splined receptacle, and a splined pin assembly for insertion through said first, second and third receptacles. The tool head includes there-through the first splined receptacle and is positioned between the upper prong and the lower prong of the handle member with the first splined receptacle coaxially aligned with the second and third splined receptacles of the handle member.

The nail extractor/moulding remover/pry bar tool head is coupled to the handle member by an indexable coupling mechanism comprising the splined pin positioned through a receptacle on the handle member and a receptacle on the nail extractor/moulding remover/pry bar tool head so that the handle member and the nail extractor/moulding remover/pry bar tool head are releasable by disengagement of the pin so that each of the handle member and nail extractor/moulding remover/pry bar tool head are rotatable relative to the other and so that when the handle and nail extractor/moulding remover/pry bar tool head are engaged by engagement of the pin the handle member and nail extractor/moulding remover/pry bar tool head are locked in position, each relative to the other.

FIGS. 1A-1E illustrate the first embodiment of the present invention being a nail extractor tool head 100 having a nail extractor 101 and a striking surface 102 on the end opposite the nail extractor 101 and an indexable coupling mechanism as described below. FIG. 1A is a top view of the nail extractor tool head 100 having nail extractor 101 in the form of a "v" cut in the surface of the nail extractor tool head 100 and a striking surface 102 on the opposite end of the nail extractor portion. FIG. 1B is a side view of the nail extractor tool head 100 having nail extractor 101 and a striking surface 102 on the opposite end of the nail extractor portion and a portion of the indexable coupling mechanism 103B/104B, as more fully described herein. FIG. 1C is a bottom view of the nail extractor tool head 100 having nail extractor 101 and a striking surface 102 on the opposite end of the nail extractor portion. As seen in FIGS. 1D and 1E, the indexable coupling mechanism couples a handle member having a first splined receptacle (shown in FIGS. 4 and 5) to the nail extractor tool head 100 using upper prong 103A with a second splined receptacle 104A and a lower prong 103B with a third splined receptacle 104B, and a splined pin assembly for insertion through said first, second and third receptacles (shown in FIGS. 4 and 5).

Figure 2B:
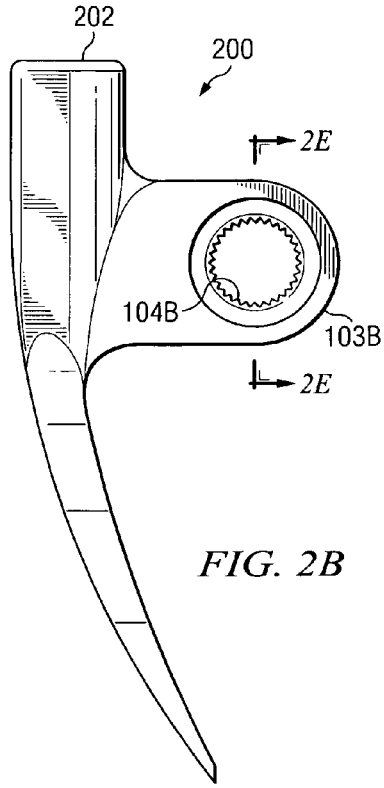
Figure 2C:
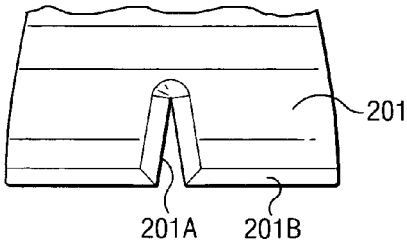
Figure 2D:
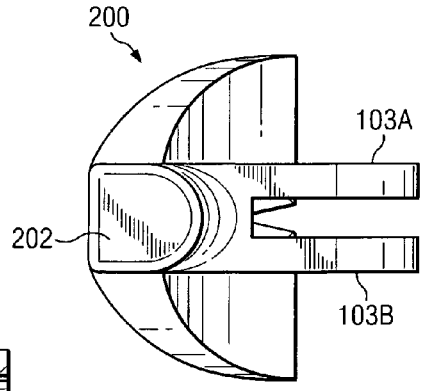
Figure 2E:
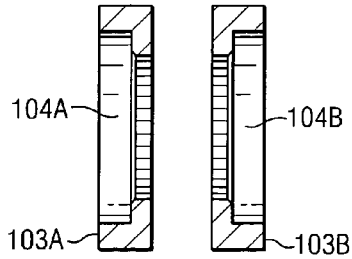

A second embodiment of the present invention is a moulding remover tool head having a striking surface on the end opposite the moulding remover surface and the indexable coupling mechanism as described below. FIGS. 2A-2E illustrate the second embodiment of the present invention being a moulding remover tool head 200 having a moulding remover 201 and a striking surface 202 on the end opposite the moulding remover 201 and an indexable coupling mechanism as described below. FIG. 2A is a top view of the moulding remover tool head 200 having a nail extractor portion 201A in the form of a "v" cut in the surface of the moulding remover tool head 200, a graduated portion of the surface 201B adapted to allow the edge of the moulding remover tool head 200 to get between, e.g., a wall and moulding and a striking surface 202 on the opposite end of the moulding remover portion. FIG. 2B is a side view of the moulding remover tool head 200 having moulding remover 201 and a striking surface 202 on the opposite end of the moulding remover portion and a portion of the indexable coupling mechanism 103B/104B, as more fully described herein. FIG. 2C is a view of the end portion of the moulding remover tool head 200 having moulding remover 201 having a nail extractor portion 201A in the form of a "v" cut in the surface of the moulding remover tool head 200, a graduated portion of the surface 201B adapted to allow the edge of the moulding remover tool head 200. As seen in FIGS. 2D and 2E, the indexable coupling mechanism couples a handle member having a first splined receptacle (shown in FIGS. 4 and 5) to the moulding remover tool head 200 using upper prong 103A with a second splined receptacle 104A and a lower prong 103B with a third splined receptacle 104B, and a splined pin assembly for insertion through said first, second and third receptacles (shown in FIGS. 4 and 5).

Figure 3A:
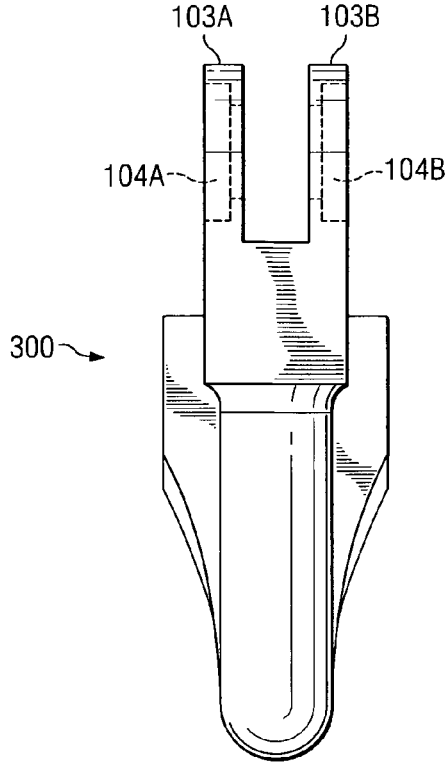
FIGS. 3A-3D are views of a heavy duty pry bar in a third embodiment of the present invention.
Figure 3B:
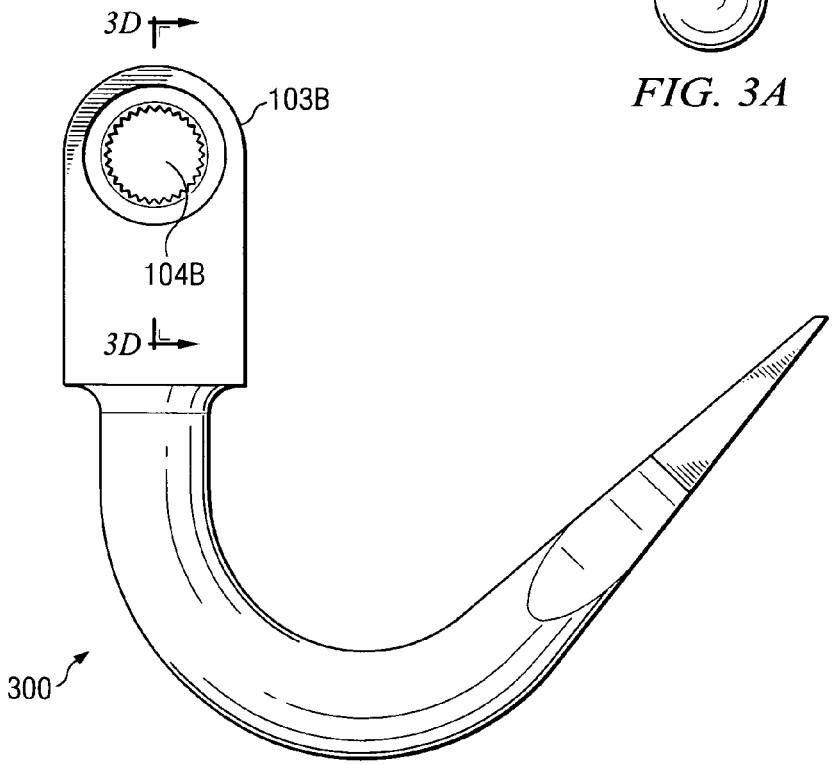
Figure 3C:
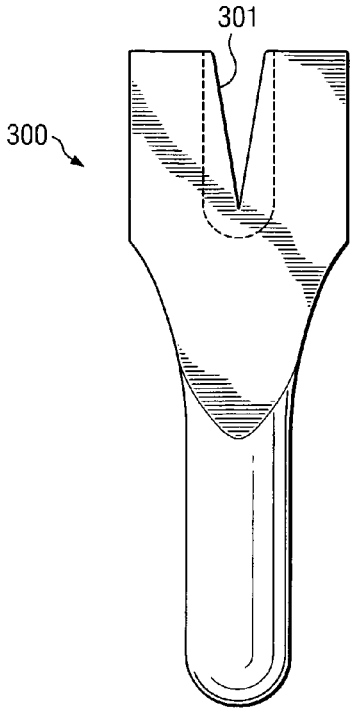
Figure 3D:
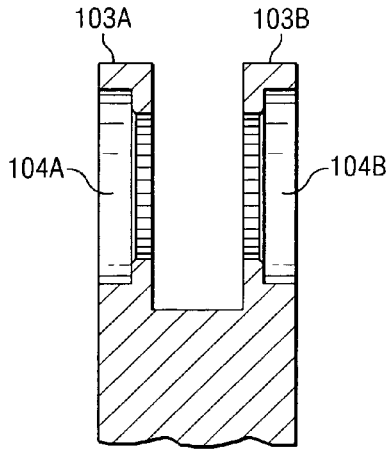

A third embodiment of the present invention is a pry bar tool head and the indexable coupling mechanism as described below. FIGS. 3A-3D illustrate the third embodiment of the present invention being a pry bar 300 and an indexable coupling mechanism as described below. FIG. 3A is top view of the pry bar tool head 300 having a nail extractor portion 301A in the form of a "v" cut in the surface of the pry bar tool head 300. FIG. 3B is a side view of the moulding remover tool head 300 and a portion of the indexable coupling mechanism 103B/104B, as more fully described herein. FIG. 3C is a view of the end portion of the pry bar tool head 300 having a nail extractor portion 301 in the form of a "v" cut in the surface of the pry bar tool head 300. As seen in FIG. 3D, the indexable coupling mechanism couples a handle member having a first splined receptacle (shown in FIGS. 4 and 5) to the pry bar tool head 300 using upper prong 103A with a second splined receptacle 104A and a lower prong 103B with a third splined receptacle 104B, and a splined pin assembly for insertion through said first, second and third receptacles (shown in FIGS. 4 and 5).

Figure 4:
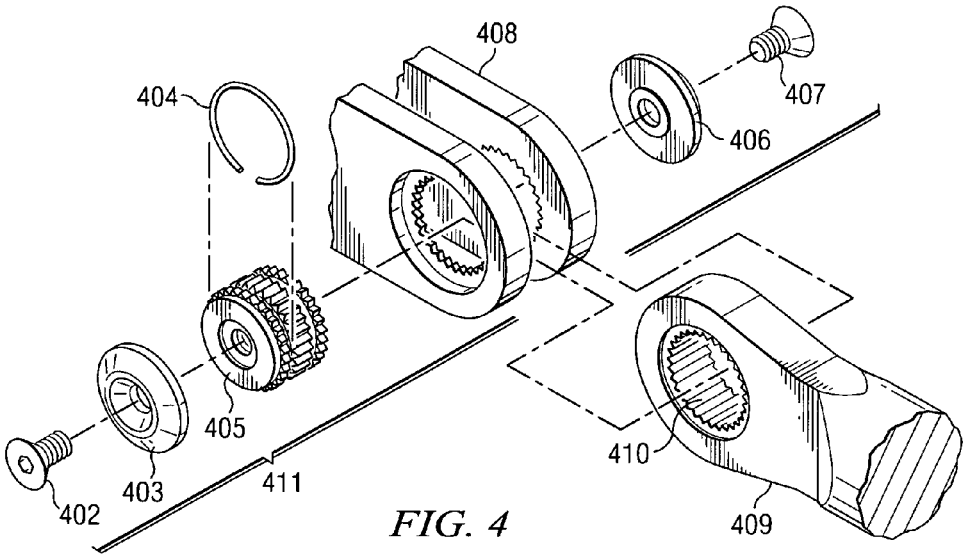
FIG. 4 is a first, exploded view of the different elements of the indexable coupling mechanism used in each embodiment of the present invention.

Referring now to FIG. 4, the indexable coupling mechanism comprises a first member 408 and a second member 409. The first member 408 has a first end and a second end. The tool head is integral to the first end of the first member 408. The second member 409 is integral to the tool handle and has a first end and second terminal end. A first extension 103A and a second extension 103B extend from the second end of the first member 408 with each of the extensions having first and second coaxial receptacle openings 104A, 104B each having an inside circumference, the receptacle openings 104A, 104B each having a row of splines positioned around its inside circumference and having a first and a second bevel around outer edges of its inside circumference. Second member 409 has a third coaxial receptacle opening 410, with splines in the central portion of its inside circumference, the first end of the second member 409 being formed to fit between the first and second extensions 103A, 103B so that the third receptacle 410 is coaxial with the first and second receptacle openings 104A, 104B. a splined pin assembly 411 has a pin 405 has a first row of splines 405A positioned around the outside of the pin on its first end, a first space 405B slightly wider than the first row of splines around the outside of the pin and adjacent the first row of splines, a second row of splines 405C wider than the first row of splines 405A positioned around the outside of the pin and adjacent the first space 405B, a v-cut 405D into pin 405 positioned around the pin adjacent the second row of splines 405C, the v-cut adapted to receive semi rigid wire 404 so that when pin 405 is pressed, the semi-rigid wire 404 is adapted to be positioned on third row of splines 405E into the bevel formed within extension 103A. The pin 405 allows the first and second members 408, 409 to rotate relative to each other and so that when the splined pin assembly 411 is pressed in one direction, the first and second member are locked into position relative to each other. A first and second end cap 403, 406 are positioned on the first and second ends of the pin 405 respectively.

Figure 5:
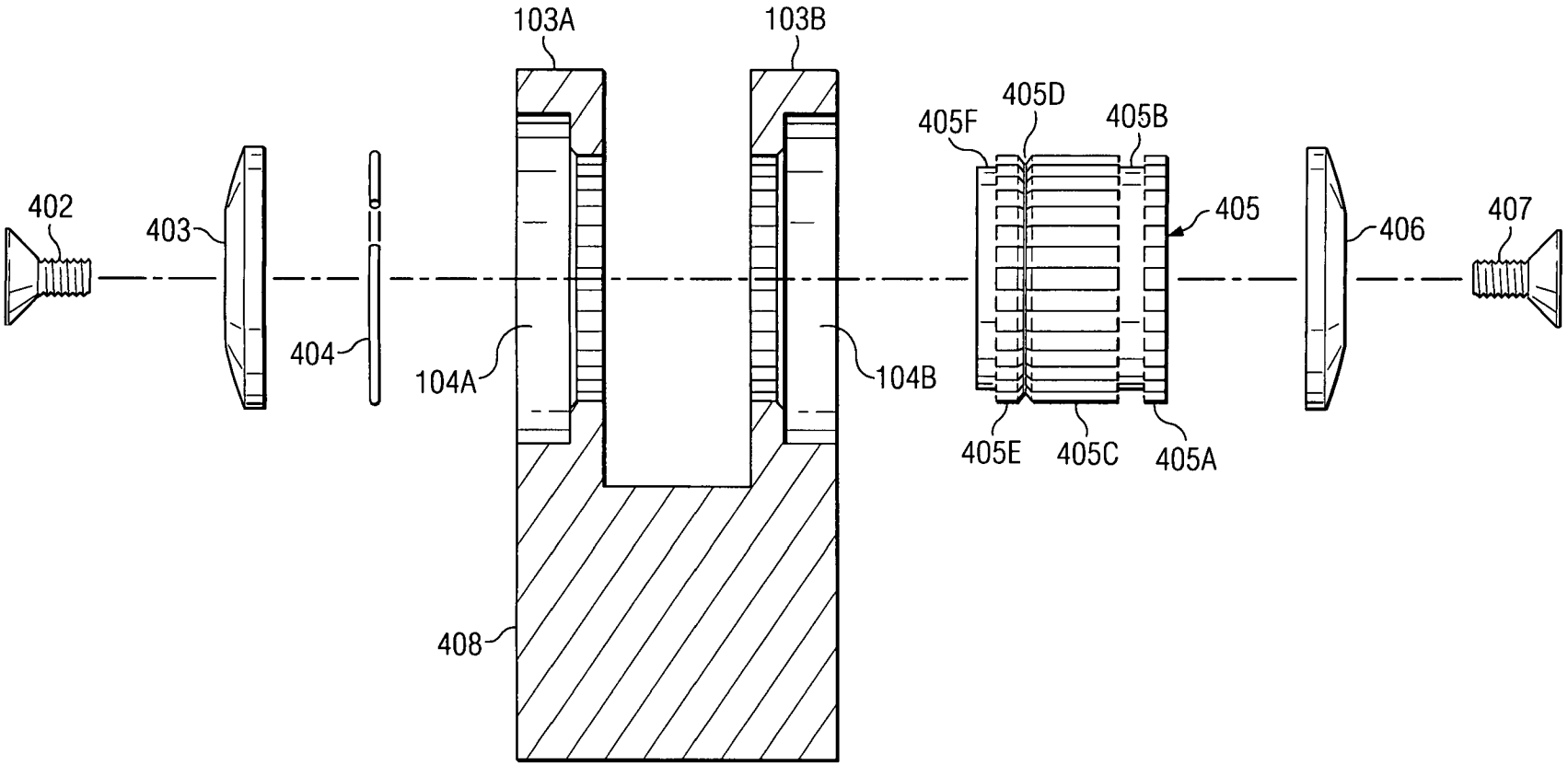
FIG. 5 is a second, exploded view of the different elements of the indexable coupling mechanism used in each embodiment of the present invention.

Referring to FIG. 5, a disassembled, exploded view of the indexable coupling mechanism is illustrated. The indexable coupling mechanism comprises a splined pin assembly 411 comprising generally cylindrical pin 405 with a first row of splines 405A around the outer circumference of the pin 405, a first square cut 405B around the circumference of the pin 405 near the first end of the pin 405 opposite the second square cut 405F, a second row of splines 405C around the outer circumference of pin 405, a v-groove channel 405D around a circumference of the pin 405 and longitudinally located between the middle and ⅓ to the second edge of the pin 405, a third row of splines 405E around the outer circumference of the pin 405 and a first square cut 405F around a outer circumference of the pin 405 commencing at a second end of the pin 405. Pin 405 has a bore there-through and is threaded at both ends of the bore. The splined pin assembly 411 further comprises a first retaining cap 403 being a circular planar member having a centered, smooth tapered bore there-though, a first screw 402 with a tapered head to be disposed through the first retaining cap 403 to couple the first retaining cap 403, via the first screw 402, with one end of the threaded bore of the pin 405; a circular wire 404 to be disposed around the pin 405 about the v-groove channel 405D (but movable from the v-groove channel 405D onto the splined portion 405F at the end of the pin 405 nearest the v-groove channel 405D when the head is in a movable position as described below); a second retaining cap 406 being a circular planar member having a centered, smooth tapered bore there-though; and a second screw 407 with a tapered head to be disposed through the second retaining cap 406 to couple the second retaining cap 406 via the second screw 407 with the other threaded bore of the pin 405.

The circular wire 404 of the splined pin assembly 411 is adapted to sit within the v groove channel 405D of the pin 405 in the locked position and is adapted to be forced by a portion of either the first or second extension 103A, 103B of the first member 408 from the v-groove channel 405D onto a portion of the pin 405 in the unlocked position when downward force is applied to the outer face of the retaining cap of the splined pin assembly 411 by the user.

Figure 6:
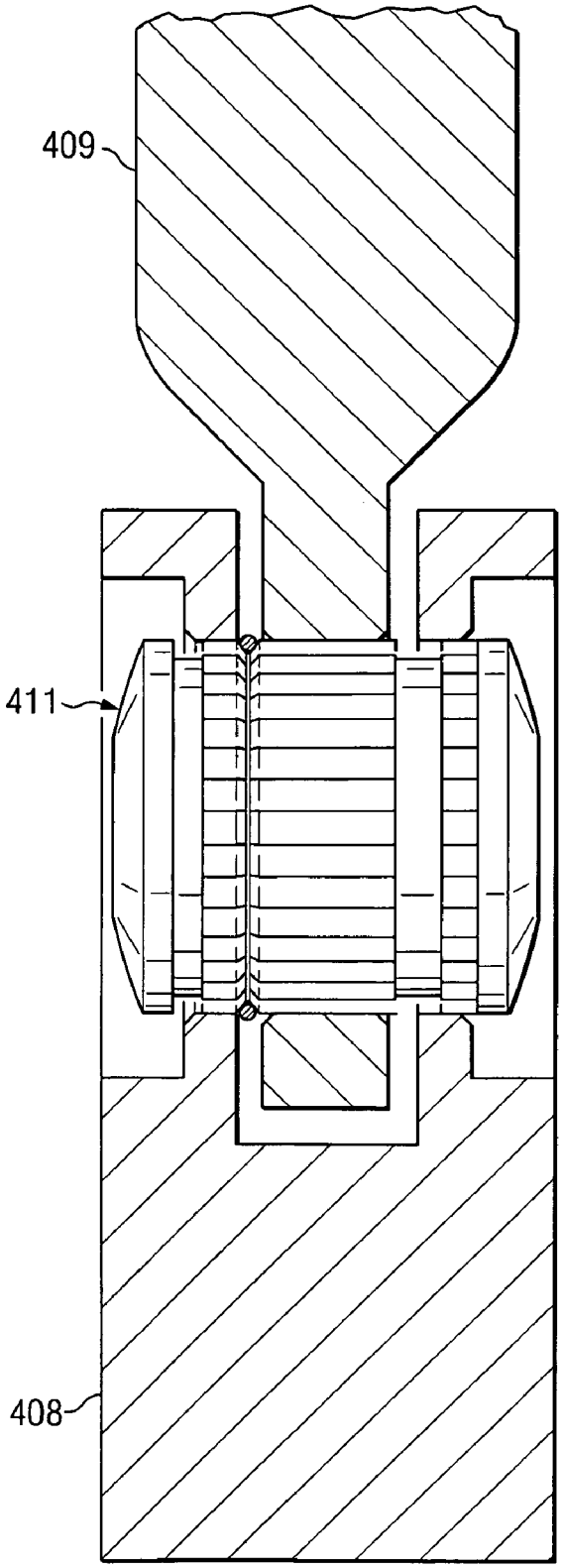
FIG. 6 is a view of the indexable coupling mechanism used in each embodiment of the present invention.

Referring to FIG. 6, a view of the indexable coupling mechanism used in each embodiment of the present invention is illustrated. As noted above, the splined pin assembly 411 is axially movable between an unlocked position and a locked position. The splined pin assembly 411 allows a user to move the splined pin axially in the first and second receptacles between the locked position and the unlocked position. The splines of the pin 405 are disposed in the first, and different portions of the first or second and third receptacles of first member 408 and second member 409, as the case may be, in the locked position and the unlocked position.

The hand tool as described herein has a first member having two extensions each extending longitudinally in a substantially parallel manner from a first end of the first member, an indexable coupling mechanism, a second member having one extension extending longitudinally from a first end of the second member, and the two extensions of the first member being coupled to the one extension of the second member using the indexable coupling mechanism. The extensions are sometimes referred to herein as prongs, the first prong and the second prong of the first member sometimes being referred to as an upper prong and a lower prong. The tool head is coupled to the second end of the first member, said second end being opposite the first end having the two extensions (or prongs). The tool head is one from the group consisting of a nail extractor, moulding remover and a pry bar. A first embodiment of the hand tool has a tool head that has a first latitudinal end comprising a nail extractor portion and a second latitudinal end having a striking surface. A second embodiment of the hand tool of has a tool head that has a first latitudinal end comprising a moulding remover portion and a second latitudinal end having a striking surface. A third embodiment of the hand tool has a tool head that is a pry bar. The second member preferably is a handle. The two extensions (or prongs) of the first member has a receptacle with a splined inner circumference thereof, the extension (prong) of the second member also has a receptacle with a splined inner circumference thereof. The indexable coupling mechanism including a splined pin assembly, the splined receptacles adapted to receive the axially aligned splined pin assembly therein. The indexable coupling mechanism is adapted to couple the first member (e.g., tool head member) and the second member (e.g., handle member) so as to permit the tool head to be pivoted, indexed and locked with respect to the second member.

The splined pin assembly is a splined pin having a first, square cut around a circumference of the splined pin commencing at the edge of the splined pin, a second v-groove cut around a circumference of the splined pin and longitudinally located between the middle and ⅓ to the edge of the splined pin, and a third square cut around the circumference of the pin near the edge of the pin opposite the first square cut, and a threaded bore centered at the ends of the splined pin. The splined pin assembly further includes a first retaining cap in the shape of a circular planar member has a centered, smooth tapered bore there-though, a first screw with a tapered head to be disposed through the first retaining cap to couple the first retaining cap, via the first screw, with one end of the threaded bore of the splined pin, a semi-rigid circular wire to be disposed around the splined pin about the v-groove of the splined pin, a second retaining cap being a circular planar member having a centered, smooth tapered bore there-though, and a second screw with a tapered head to be disposed through the second retaining cap to couple the second retaining cap via the second screw with the other threaded bore of the splined pin. The semi-rigid circular wire is adapted to sit about the v groove channel of the splined pin and is adapted to be forced by a portion of the upper prong of the second member from the v-groove onto a portion of the splined pin in the unlocked position when downward force is applied to the outer face of the retaining cap of the splined pin assembly by the user. More specifically, the splined pin has a square channel cut located a length "L" from the end thereof, about halfway to ⅔ from the end, the square channel cut being located to correspond generally with the distances of the smooth square cut portions and splined portions of the upper and lower prongs of the second member. The square channel cut operable to create a first splined portion and a second splined portion, the distance of the square channel cut from the end of the splined pin, in association with the splined portions of the upper prong and lower prong of second member, is operable to lock and unlock the first member and second member. In operation, the splined pin is disposed in the three splined receptacles and is axially movable between an unlocked position and a locked position based on the position of the splined portion of splined pin in relation to the splined portion of either the second receptacle of the upper prong or the splined portion of the third receptacle of the lower prong of second member. When the splined portion of the splined pin is misaligned with the splined portion of the upper prong or lower prong, as the case may be, then the second member is free to move relative to the first member, and hence, the tool is in the unlocked position and when the splined portion of the splined pin is aligned with the splined portion of the upper prong or lower prong, as the case may be then the second member is not free to move relative to the first member, and hence, is in the locked position.

In three embodiments of the present invention, the first member 408 comprises the nail extractor, moulding remover or pry bar tool head and second member 409 comprises a tool handle. In a further, or fourth, embodiment, the second member comprises an extension, and a third member comprises a tool handle. In the fourth, extension embodiment, there are two splined pin assemblies, one splined pin assembly located at the first end of a hand tool extension, e.g., proximate the hand tool, and the second splined pin assembly located at the opposite end of the hand tool extension, proximate the handle. However, as would be obvious to one skilled in the art, the two extension/receptacle configuration of the first member can be interchanged with the second member and vice versa. The present invention is intended to cover all such variations and configurations. While the nail extractor/moulding remover/pry bar tool shown and described has been characterized as being preferred, it will be readily apparent that various changes and modifications could be made therein without departing from the scope of the invention.

I claim:

1. A hand tool, comprising:

a first member having two extensions each extending longitudinally in a substantially parallel manner from a first end of the first member;

an indexable coupling mechanism;

a second member having one extension extending longitudinally from a first end of the second member;

the two extensions of the first member being coupled to the one extension of the second member using the indexable coupling mechanism;

wherein:

each of the two extensions of the first member having a receptacle with a splined inner circumference thereof, the extension of the second member having a receptacle with a splined inner circumference thereof;

the indexable coupling mechanism including a splined pin assembly, the splined receptacles adapted to receive the axially aligned splined pin assembly therein, the indexable coupling mechanism adapted to couple the first member and the second member so as to permit the first member to be pivoted, indexed and locked with respect to the second member, further wherein the splined pin assembly further comprises:

a splined pin having a first, square cut around a circumference of the splined pin commencing at the edge of the splined pin, a second v-groove cut around a circumference of the splined pin and longitudinally located between the middle and ⅓ to the edge of the splined pin, and a third square cut around the circumference of the pin near the edge of the pin opposite the first square cut, and a threaded bore centered at the ends of the splined pin;

a first retaining cap being a circular planar member having a centered, smooth tapered bore there-though;

a first screw with a tapered head to be disposed through the first retaining cap to couple the first retaining cap, via the first screw, with one end of the threaded bore of the splined pin;

a semi-rigid circular wire to be disposed around the splined pin about the v-groove of the splined pin;

a second retaining cap being a circular planar member having a centered, smooth tapered bore there-though; and a second screw with a tapered head to be disposed through the second retaining cap to couple the second retaining cap via the second screw with the other threaded bore of the splined pin.

2. The hand tool of claim 1, further comprising a tool head coupled to the second end of the first member, said second end being opposite the first end having the two extensions.

3. The hand tool of claim 2, wherein the tool head is one from the group consisting of a nail extractor, moulding remover and a pry bar.

4. The hand tool of claim 2, wherein the tool head has a first latitudinal end comprising a nail extractor portion and a second latitudinal end having a striking surface.

5. The hand tool of claim 2, wherein the tool head has a first latitudinal end comprising a moulding remover portion and a second latitudinal end having a striking surface.

6. The hand tool of claim 1, wherein the second member is a handle.

7. The hand tool of claim 1, wherein the semi-rigid circular wire is adapted to sit about the v groove channel of the splined pin and is adapted to be forced by a portion of the upper prong of the second member from the v-groove onto a portion of the splined pin in the unlocked position when downward force is applied to the outer face of the retaining cap of the splined pin assembly by the user.

8. The hand tool of claim 7, further comprising the splined pin having a square channel cut located a length "L" from the end thereof, about halfway to ⅔ from the end;

the square channel cut being located to correspond generally with the distances of the smooth square cut portions and splined portions of the upper and lower prongs of the second member;

the square channel cut operable to create a first splined portion and a second splined portion; and the distance of the square channel cut from the end of the splined pin, in association with the splined portions of the upper prong and lower prong of second member operable to lock and unlock the first member and second member.

9. The hand tool of claim 8 wherein the splined pin is disposed in the three splined receptacles and is axially movable between an unlocked position and a locked position based on the position of the splined portion of splined pin in relation to the splined portion of either the second receptacle of the upper prong or the splined portion of the third receptacle of the lower prong of second member.

10. The hand tool of claim 9, wherein when the splined portion of the splined pin is misaligned with the splined portion of the upper prong or lower prong, as the case may be, then the second member is free to move relative to the first member, and hence, the tool is in the unlocked position; and when the splined portion of the splined pin is aligned with the splined portion of the upper prong or lower prong, as the case may be then the second member is not free to move relative to the first member, and hence, is in the locked position.

11. A hand tool, comprising:

a first member having two extensions each extending longitudinally in a substantially parallel manner from a first end of the first member;

an indexable coupling mechanism;

a second member having one extension extending longitudinally from a first end of the second member;

the two extensions of the first member being coupled to the one extension of the second member using the indexable coupling mechanism;

the indexable coupling mechanism further comprising:

the first member having a tool head on an end opposite the extensions;

the second member being a handle and a first substantially splined receptacle;

the first member nail extractor head having an orthogonal member having an upper prong with a second splined receptacle and a lower prong with a third splined receptacle; and a splined pin assembly adapted to be inserted through the first, second and third receptacles.

12. A tool, comprising:

a tool head member having two prongs, being an upper prong and a lower prong, each extending longitudinally in a substantially parallel manner from a first end of the tool head member;

an indexable coupling mechanism;

a handle member having one prong extending longitudinally from a first end of the second member, wherein the upper prong and lower prong of the tool head member are disposed in spaced-apart relation with a gap there between for receiving the handle member prong; and the two prongs of the tool head member being coupled to the one prong of the handle member using the indexable coupling mechanism;

wherein each of the two prongs of the tool head member has a receptacle with a splined inner circumference thereof, the prong of the second member having a receptacle with a splined inner circumference thereof, the indexable coupling mechanism including a splined pin assembly, the splined receptacles adapted to receive the axially aligned splined pin assembly therein, the indexable coupling mechanism adapted to couple the tool head member and the handle member so as to permit the tool head member to be pivoted, indexed and locked with respect to the handle member;

further comprising the one prong of the handle member being positioned between an upper prong and a lower prong of the tool head member with the first splined receptacle coaxially aligned with the second and third splined receptacles of the upper and lower prongs of the tool head member;

further comprising the receptacle on the upper prong and the receptacle on the lower prong each having a smooth square cut portion having a first radius circumferentially and extending a length from the outer face to a depth of about halfway to ⅔ to the inner face of the respective prong and a splined portion having a second radius circumferentially less than the first radius and extending from about halfway to ⅔ from the outer face to the inner face of the respective prong.

13. The tool of claim 12, wherein the splined pin assembly comprises:

a splined pin having a first, square cut around a circumference of the splined pin commencing at the edge of the splined pin, a second v-groove cut around a circumference of the splined pin and longitudinally located between the middle and ⅓ to the edge of the splined pin, and a third square cut around the circumference of the pin near the edge of the pin opposite the first square cut, and a threaded bore centered at the ends of the splined pin;

a first retaining cap being a circular planar member having a centered, smooth tapered bore there-though;

a first screw with a tapered head to be disposed through the first retaining cap to couple the first retaining cap, via the first screw, with one end of the threaded bore of the splined pin;

a semi-rigid circular wire to be disposed around the splined pin about the v-groove of the splined pin, the semi-rigid circular wire is adapted to sit about the v groove channel of the splined pin and is adapted to be forced by a portion of the upper prong of the second member from the v-groove onto a portion of the splined pin in the unlocked position when downward force is applied to the outer face of the retaining cap of the splined pin assembly by the user;

a second retaining cap being a circular planar member having a centered, smooth tapered bore there-though;

a second screw with a tapered head to be disposed through the second retaining cap to couple the second retaining cap via the second screw with the other threaded bore of the splined pin.

14. The tool of claim 13, wherein the splined pin assembly further comprises:

the splined pin having a square channel cut located a length "L" from the end thereof, about halfway to ⅔ from the end;

the square channel cut being located to correspond generally with the distances of the smooth square cut portions and splined portions of the upper and lower prongs of the second member;

the square channel cut operable to create a first splined portion and a second splined portion; and the distance of the square channel cut from the end of the splined pin, in association with the splined portions of the upper prong and lower prong of second member operable to lock and unlock the first member and second member.

15. The tool of claim 14 wherein the splined pin is disposed in the three splined receptacles and is axially movable between an unlocked position and a locked position based on the position of the splined portion of splined pin in relation to the splined portion of either the second receptacle of the upper prong or the splined portion of the third receptacle of the lower prong of second member.

16. The tool of claim 15, wherein when the splined portion of the splined pin is misaligned with the splined portion of the upper prong or lower prong, as the case may be, then the second member is free to move relative to the first member, and hence, the tool is in the unlocked position; and when the splined portion of the splined pin is aligned with the splined portion of the upper prong or lower prong, as the case may be then the second member is not free to move relative to the first member, and hence, is in the locked position.

* * * * *